US009953599B2

(12) United States Patent
Kim et al.

(10) Patent No.: US 9,953,599 B2
(45) Date of Patent: Apr. 24, 2018

(54) DISPLAY DEVICE AND DRIVING BOARD

(71) Applicant: SAMSUNG ELECTRONICS CO., LTD., Suwon-si (KR)

(72) Inventors: Tae-hoon Kim, Suwon-si (KR); Tae-hyeun Ha, Suwon-si (KR); Jea-hee Han, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/078,477

(22) Filed: Mar. 23, 2016

(65) Prior Publication Data

US 2016/0284299 A1 Sep. 29, 2016

(30) Foreign Application Priority Data

Mar. 23, 2015 (KR) ..... 10-2015-0040078

(51) Int. Cl.
*G09G 3/36* (2006.01)

(52) U.S. Cl.
CPC ..... *G09G 3/3648* (2013.01); *G09G 3/3696* (2013.01); *G09G 2310/0291* (2013.01); *G09G 2310/04* (2013.01); *G09G 2310/08* (2013.01); *G09G 2330/021* (2013.01)

(58) Field of Classification Search
None
See application file for complete search history.

(56) References Cited

U.S. PATENT DOCUMENTS 6,867,758 B2 * 3/2005 Nah ..... G02F 1/13452 345/206
2005/0225526 A1 * 10/2005 Chiu ..... G09G 3/3688 345/98
2009/0213042 A1 * 8/2009 Hagino ..... G09G 3/2011 345/55
2012/0001950 A1 * 1/2012 Kim ..... G09G 3/3291 345/690
2016/0133179 A1 * 5/2016 Choi ..... G09G 3/2092 345/212

* cited by examiner

*Primary Examiner* — Kenneth Bukowski
(74) *Attorney, Agent, or Firm* — Sughrue Mion, PLLC

(57) ABSTRACT

A display device and a driving board are provided. The display device includes a buffer configured to generate a applied voltage corresponding to a driving control signal; a liquid crystal display (LCD) panel configured to change a liquid crystal transmittance thereof in accordance with the applied voltage; a switcher configured to selectively provide an intermediate voltage of a predetermined level, which makes the LCD panel transmit no light, to the LCD panel; and a driving controller configured to control the switcher to block power from being supplied to the buffer and to provide the intermediate voltage to the LCD panel in response to a predetermined event occurring.

17 Claims, 12 Drawing Sheets

DISPLAY DEVICE AND DRIVING BOARD

CROSS-REFERENCE TO RELATED APPLICATIONS

This application claims priority from Korean Patent Application No. 10-2015-0040078 filed on Mar. 23, 2015 in the Korean Intellectual Property Office, the disclosure of which is incorporated herein by reference in its entirety.

BACKGROUND

Field

Apparatuses consistent with exemplary embodiments relate to a display device and a driving board, and more particularly, to a display device and a driving board, which can block light transmission through a thin-film transistor (TFT) pixel even in a state where a buffer for driving the corresponding TFT pixel stops its operation.

Description of the Related Art

A display device is a device which processes and displays digital or analog video signals that are received from an external source or various video signals stored in an internal storage device as compressed files. In this case, the digital or analog video signals that are received from the external source may be broadcasting signals, digital satellite broadcasting signals, or signals that are transmitted from various kinds of external devices (e.g., a set-top box, a disk player, a mobile device, and a PC) or servers based on Internet protocols.

Recently, various display devices have been developed, and a display device that has widely been used is an liquid crystal display (LCD) device. The LCD device is driven by an electric potential difference between a pixel electrode and a common electrode, and in accordance with such an electric potential difference, grayscales are displayed through transmission of light that is emitted from a backlight through an liquid crystal (LC) or adjustment of the degree of the light transmission.

An LCD panel has different LC structures depending on the characteristics thereof, and is generally classified into a normally black panel that blocks the backlight light when the electric potential of a pixel electrode is equal to the electric potential of a common electrode and a normally white panel that blocks the backlight light when the electric potential of the pixel electrode is different from the electric potential of the common electrode.

On the other hand, for the lifespan and reliability, a recent LCD device applies a pixel electric potential with (+) electric potential difference or (−) electric potential difference based on a voltage value of the common electrode. Accordingly, in the case of the normally black panel, if the pixel electric potential is not applied thereto, an electric potential difference occurs between the pixel electric potential and the electric potential of the common electrode, and thus the backlight light is emitted.

That is, in the related art, even in the case where pixel data is kept constant without any change or pixels are turned off to be unused, a pixel drive buffer of a source driver should continuously operate to cause the occurrence of power consumption.

SUMMARY

Exemplary embodiments of the present disclosure overcome the above disadvantages and other disadvantages not described above. However, exemplary embodiments of the present disclosure are not required to address the aforementioned disadvantages, and an aspect may not address the aforementioned disadvantages.

One or more exemplary embodiments provide a display device and a driving board, which can block light transmission through a TFT pixel even in a state where a buffer for driving the corresponding TFT pixel stops its operation.

According to an aspect of an exemplary embodiment, there is provided a display device a buffer configured to generate a applied voltage corresponding to a driving control signal; a liquid crystal display (LCD) panel configured to change a liquid crystal transmittance thereof in accordance with the applied voltage; a switcher configured to selectively provide an intermediate voltage of a predetermined level, which makes the LCD panel transmit no light, to the LCD panel; and a driving controller configured to control the switcher to block power from being supplied to the buffer and to provide the intermediate voltage to the LCD panel in response to a predetermined event occurring.

The LCD panel may be a normally black panel that blocks light in the case where the applied voltage is equal to a common voltage.

The common voltage may have an intermediate level in a change range of the applied voltage that is applied to the LCD panel.

The intermediate voltage may have a voltage level that is equal to common voltage level.

The intermediate voltage may have an intermediate level in a change range of the applied voltage that is applied to the LCD panel.

The buffer may be configured to alternately generate the applied voltage that is higher or lower than the common voltage to an extent of an electric potential difference corresponding to the driving control signal based on the common voltage.

The buffer may be configured to receive a gamma voltage to generate the applied voltage, and the switcher is configured to generate the intermediate voltage by using the gamma voltage.

The display device may further include a plurality of buffers including the buffer, and a plurality of switchers including the switcher, and the driving controller may be configured to control power supply states of the plurality of buffers, and control operations of the plurality of switchers corresponding to the respective buffers in accordance with the power supply states of the plurality of buffers.

At least one of the plurality of buffers may be in a normal state, and remaining buffers of the plurality of buffers, other than the least one of the plurality of buffers, may be in a power blocking state.

The driving controller may be configured to sense a column in which all rows output black images, block power from being supplied to a buffer corresponding to the sensed column and control a switcher corresponding to the buffer to provide the intermediate voltage to the LCD panel.

The buffer, the switcher, and the driving controller may be arranged on a source printed board assembly.

According to an aspect of another exemplary embodiment, there is provided a driving board for driving a liquid crystal display (LCD) panel, the driving board including: a buffer configured to generate an applied voltage corresponding to a driving control signal, and to provide the generated applied voltage to the LCD panel; a switcher configured to selectively provide an intermediate voltage of a predetermined level, which makes the LCD panel transmit no light, to the LCD panel; and a driving controller configured to control the switcher to block power from being supplied to the buffer and to provide the intermediate voltage to the LCD panel in response to a predetermined event occurring.

The driving board may further include a plurality of buffers including the buffer, and a plurality of switchers including the switcher, and the driving controller may be configured to control power supply states of the plurality of buffers, and control operations of the plurality of switchers corresponding to the respective buffers in accordance with the power supply states of the plurality of buffers.

At least one of the plurality of buffers may be in a normal state, and remaining buffers of at least one of the plurality of buffers, other than the at least one of the plurality of buffers, may be in a power blocking state.

The driving controller may be configured to sense a column in which all rows output black images, blocks the power from being supplied to the buffer that corresponds to the sensed column, and controls the switcher that corresponds to the buffer to provide the intermediate voltage to the LCD panel.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
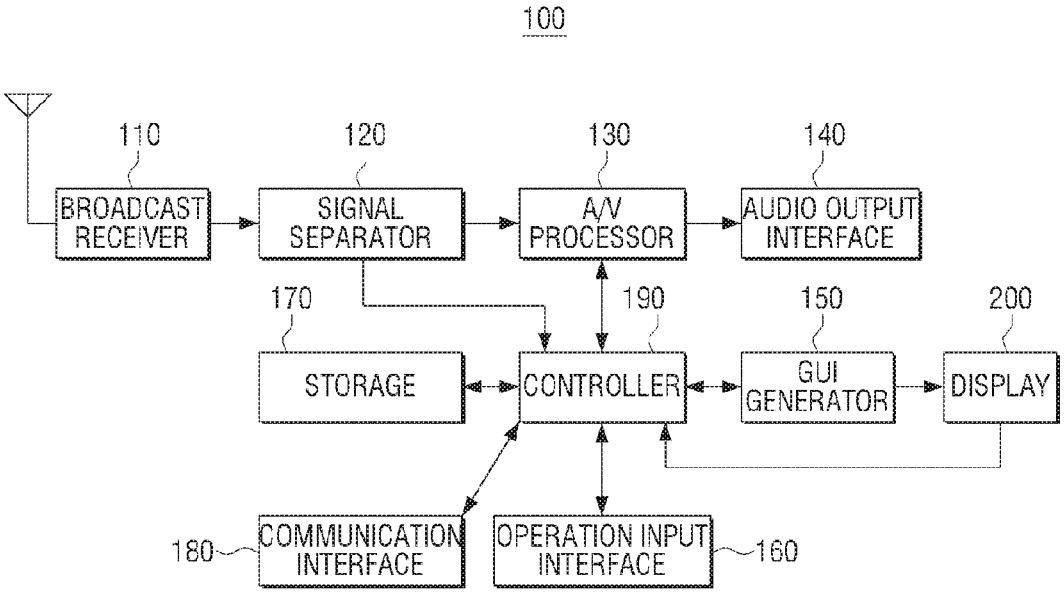
FIG. 1 is a block diagram schematically illustrating the configuration of a display device according to an exemplary embodiment.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail because they would obscure the disclosure with unnecessary detail.

The terms "first," "second," etc. may be used to describe diverse components, but the components are not limited by the terms. The terms are only used to distinguish one component from another component. In addition, it will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

The terms used in the present application are only used to describe the exemplary embodiments, but are not intended to limit the scope of the disclosure. In addition, the singular expression does not limit the present disclosure to have singular component or step. Instead, the present disclosure may comprise multiple components or steps even it is described in singular express. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor.

Hereinafter, the present disclosure will be described in detail with reference to the accompanying drawings.

Hereinafter, exemplary embodiments of the present disclosure will be described in detail with reference to the accompanying drawings.

FIG. 1 is a block diagram illustrating the configuration of a digital TV that is an example of a display device according to an exemplary embodiment.

Referring to FIG. 1, a display device 100 according to this embodiment includes a broadcast receiver 110, a signal separator 120, an audio/video (A/V) processor 130, an audio output interface 140, a graphic user interface (GUI) generator 150, an operation input interface 160, a storage 170, a communication interface 180, a controller 190, and a display 200.

The broadcast receiver 110 may receive a broadcasting signal in a wired or wireless manner from a broadcasting station or a satellite and demodulate the received broadcasting signal.

The signal separator 120 may separate the broadcasting signal into a video signal, an audio signal, and an additional information signal. Further, the signal separator 120 may transmit the video signal and the audio signal to the A/V processor 130.

The A/V processor 130 may perform signal processing, such as video decoding, video scaling, and audio decoding, with respect to the video signal and the audio signal that are input from the broadcast receiver 110 and/or the storage 170. Further, the A/V processor 130 may output the video signal to the GUI generator 150 and output the audio signal to the audio output interface 140.

In the case of storing the received video and audio signals in the storage 170, the A/V processor 130 may compress the video and audio signals and store the compressed video and audio signals in the storage 170.

The audio output interface 140 may convert the audio signal that is output from the A/V processor 130 into sound, and may output the sound through a speaker or to an external device connected thereto through an external output terminal.

The GUI generator 150 may generate a GUI to provide the generated GUI to a user. Further, the GUI generator 150 may add the generated GUI to an image that is output from the A/V processor 130. Further, the GUI generator 150 may provide the image that is added with the GUI to the display 200.

The operation input interface 160 may set or select various kinds of functions that are supported by the display device 100. Specifically, the operation input interface 160 may receive an input of a user command through a button or the like that is arranged on the display device 100 itself or through a remote control device (e.g., remote controller).

The display 200 may display various kinds of information provided by the display device 100 or the image transferred from the GUI generator 150. The detailed configuration and operation of the display 200 will be described later with reference to FIG. 2. On the other hand, in this embodiment, the operation input interface 160 and the display 200 are separately configured. However, they may be implemented by one device, such as a touch screen.

The storage 170 may store video content. Specifically, the storage 170 may receive and store video content, in which video and audio are compressed, from the A/V processor 130, and may output the stored video content to the A/V processor 130 under the control of the controller 190. The storage 170 may be implemented by a hard disk, a nonvolatile memory, and/or a volatile memory.

The communication interface 180 may be provided to connect the display device 100 to an external device through not only LAN (Local Area Network) and the Internet but also a USB (Universal Serial Bus) port.

The controller 190 controls the whole operations of the display device 100. Specifically, the controller 190 may determine the operating state of the display device 100. More specifically, if the display device 100 is required to output only the audio or to output the image through only a partial region of a screen, the controller 190 may determine that the present operating mode is a power saving mode. On the other hand, in the case of outputting the image through only the partial region of the screen, the controller 190 may determine a region that operates in a power saving mode and a region that operates in a normal mode.

If it is determined that the operating mode of the display device 100 is the power saving mode, the controller 190 may control the display 200 to operate according to the determined power saving mode. That is, the controller 190 may provide information about reduction of power consumption to the display 200. In this case, the information that is transferred to the display 200 may be information on the power saving mode and region information (or pixel information or row information) to operate in the power saving mode.

As described above, even in the case where pixel data is kept constant without any change or pixels are turned off to be unused, the display device according to this embodiment can block the power supply to a pixel drive buffer, and thus power consumption can be minimized.

FIG. 1 exemplifies that the above-described function is applied to the display device that receives and displays the broadcast. However, the power consumption reduction technology to be described later can be applied to any electronic device having a display panel.

Further, FIG. 1 exemplifies that the controller 190 determines whether to operate in the power saving mode and the region that operates in the power saving mode. However, such an operation may be performed by the display 200.

Figure 2:
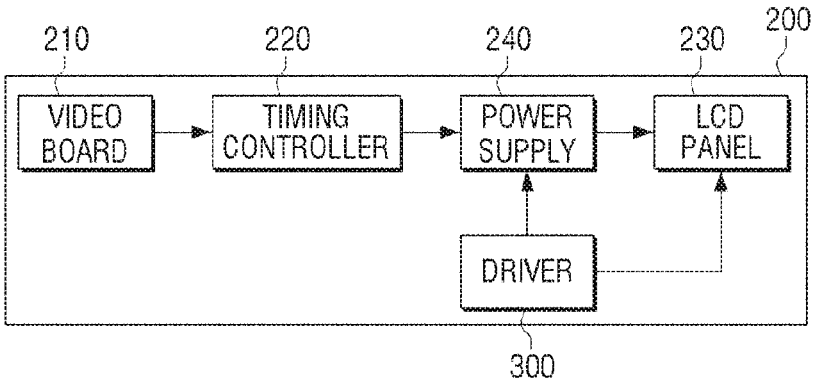
FIG. 2 is a block diagram illustrating the detailed configuration of a display of FIG. 1.

FIG. 2 is a block diagram illustrating the detailed configuration of a display of FIG. 1.

Referring to FIG. 2, a display 200 includes a video board 210, a timing controller 220, an LCD panel 230, a power supply 240, and a driver 300.

On the video board 210, circuits or chips for video processing and overall control of the display may be arranged. Specifically, the video board 210 may process content stored in the storage 170 or a video signal transferred from the signal separator 120. For example, the video board 210 may process an input video signal and generate a red, green, and blue (RGB) video signal and input control signals. Here, the input control signals may include a data enable signal DE, a horizontal sync signal Hsync, a vertical sync signal Vsync, and a main clock signal MCLK.

Further, the video board 210 may transmit the processed video signal to the timing controller 220.

The timing controller 220 may generate driving control signals corresponding to the processed video signal. Specifically, the timing controller 220 may generate a data signal through processing of the input RGB video signal.

Further, the timing controller 220 may generate a gate driving control signal and a source driving control signal through processing of the input control signals. That is, the above-described driving control signals may include the data signal, the gate driving control signal, and the source driving control signal. Further, the timing controller 220 may transmit the data signal and the source driving control signal to the source driver 320, and transmit the gate driving control signal to the gate driver 310.

Here, the timing controller 220 may transmit the driving control signal to the driver 300 using any one interface of Reduced Swing Differential Signaling (RSDS), Mini-Low-Voltage Differential Signaling (LVDS), Point to Point Differential Signaling (PPDS), Low-Voltage Differential Signaling (LVDS), Advanced intra-panel interface (Aipi), Samsung Video Digital Link (SVDL), and V-by-One (Vx1).

The display panel 230 may have liquid crystal transmittance that is changed in accordance with the applied voltage. Specifically, the display panel 230 may have a liquid crystal layer interposed between two glass substrates, and may include m×n liquid crystal cells Clc that are arranged in the form of a matrix in which m gate lines and n data lines crossed each other.

Specifically, on a lower glass substrate of the LCD panel 230, data lines, gate lines, TFTs, pixel electrodes of the liquid crystal cells Clc connected to the TFTs, and storage capacitors may be formed. Further, on the lower glass substrate of the LCD panel 230, line-on glass lines for transmitting data, a data timing control signal, and a driving voltage may be formed between the above-described source chips on film (COFs).

On an upper glass substrate of the LCD panel 230, color filters and a common electrode may be arranged.

The driver 300 may drive the LCD panel 230 in accordance with the driving control signal. Specifically, the driver 300 may generate the applied voltage corresponding to the driving control signal and provide the generated applied voltage to the LCD panel 230.

Further, the driver 300 may sense whether a predetermined event has occurred. If the predetermined event has occurred, the driver 300 may selectively provide an intermediate voltage of a predetermined level, which makes the LCD panel 230 transmit no light, to the LCD panel 230. The detailed configuration of the driver 300 will be described later with reference to FIG. 4.

The power supply 240 may generate a gamma voltage VDD and a common voltage that are used in the LCD panel 230 and the driver 300. Further, the power supply 240 may generate power that is composed of DC and Low Drop Out (LDO) used in the timing controller 220, the driver 300, and the LCD panel 230.

As described above, even in the case where the pixel data is kept constant without any change or the pixels are turned off, the display 200 according to this embodiment can block the power supplied to the pixel drive buffer, and thus power consumption can be minimized.

FIG. 2 illustrates that one driver is arranged in the display 200. However, a plurality of drivers may be arranged. Such an example will now be described with reference to FIG. 3.

Figure 3:
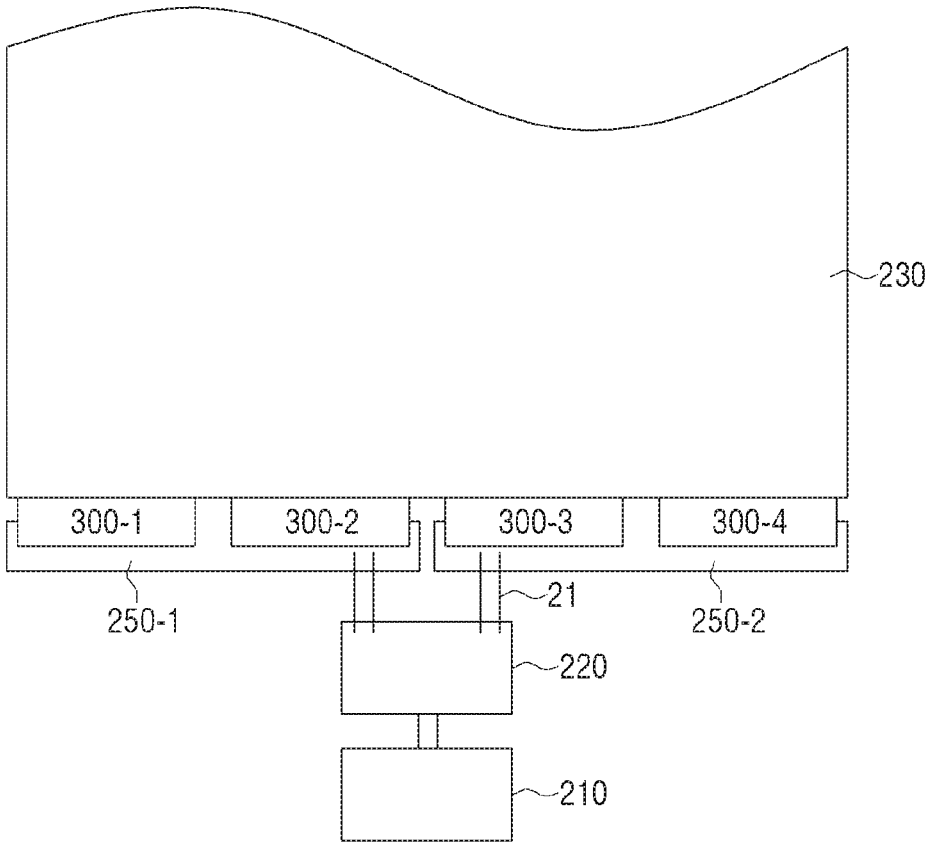
FIG. 3 is a diagram explaining an arrangement type of a driver.

FIG. 3 is a diagram explaining the arrangement type of a driver.

Recently, the display device 100 having a large size is adopted, it is cost-effective and easy in system implementation to use a plurality of drivers to drive the LCD panel instead of using only one single driver.

Referring to FIG. 3, the display 200 may include the video board 210, the timing controller 220, source printed circuit boards (PCBs) 250-1 and 250-2, a wire cable connected to the video board 210 and the timing controller 220, a cable 21 connected to the timing controller 220 and the source PCBs 250-1 and 250-2, and a plurality of source COFs 300-1, 300-2, 300-3, and 300-4 connected to the source PCBs 250-1 and 250-2 and the LCD panel 230.

The video board 210 may include an analog-to-digital converter, a scaler, and a signal interpolation circuit. The video board 210 may convert data supplied from an external source through an interface circuit to match the resolution of the LCD panel 230, and compensate for picture quality deterioration caused by the resolution conversion through a signal interpolation.

The timing controller 220 may have a control circuit and a data transmission circuit. The timing controller 220 may supply the data supplied from the video board 210 through a cable to data integrated circuits (ICs) of the source PCBs 250-1 and 250-2, and generate timing control signals for controlling the operation of the data ICs to supply the generated timing control signals to the source PCBs 250-1 and 250-2.

The source COFs 300-1, 300-2, 300-3, and 300-4 may be electrically connected to the source PCBs 250-1 and 250-2 and data pads of the LCD panel 230. On the source COFs 300-1, 300-2, 300-3, and 300-4, the data ICs may be mounted.

On the source COFs 300-1, 300-2, 300-3, and 300-4, signal lines for transmitting the digital video data and the timing control signals from the timing controller 220 may be formed.

FIGS. 2 and 3 illustrate that the video board 210 and the timing controller 230 are separately configured. However, the timing controller 220 may be arranged on the video board 210. Further, the timing controller 220 and the driver 300 may be integrated on one board.

Figure 4:
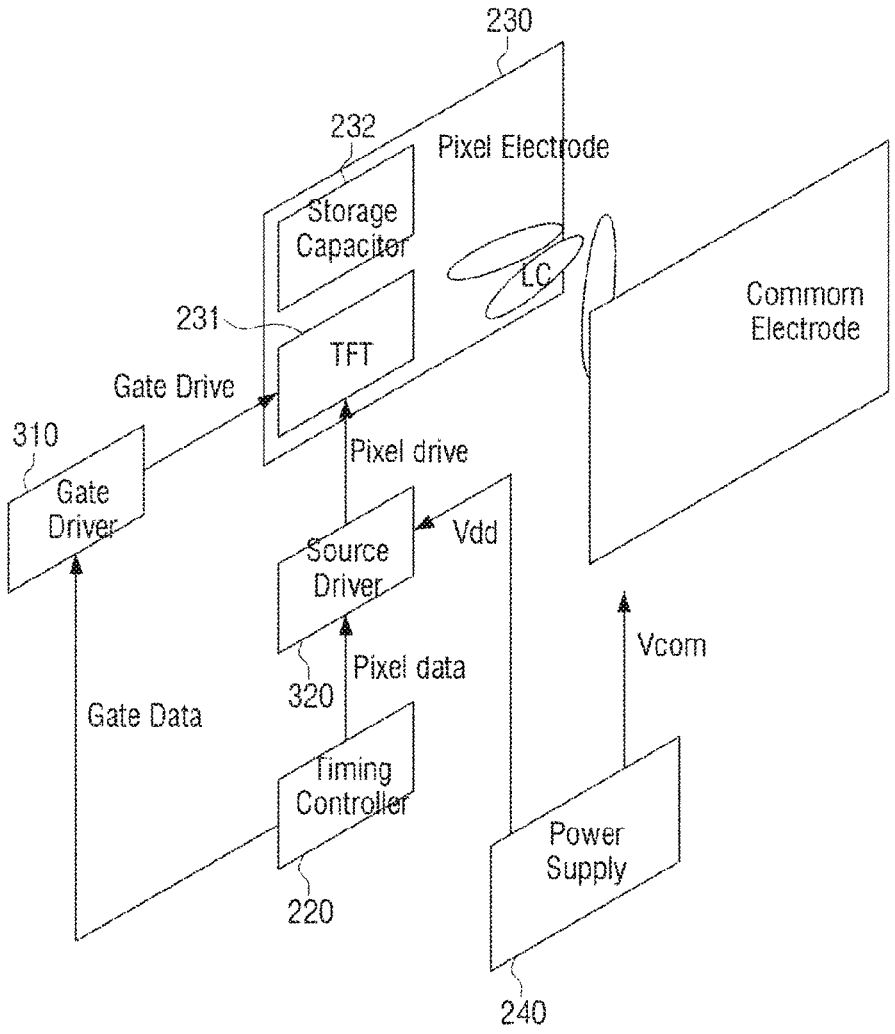
FIG. 4 is a diagram explaining the operation principle of an LCD panel.

FIG. 4 is a diagram explaining the operation principle of an LCD panel.

The timing controller 220 may be arranged on the video board 110 and may generate the driving control signals corresponding to the processed video signal. That is, the timing controller 220 may control the operations of the LCD panel 230 and a backlight using the driving control signals.

Specifically, the timing controller 220 may generate a data signal through processing of the input RGB signal. Further, the timing controller 220 may generate a gate driving control signal and a source driving control signal through processing of the input control signals.

Further, the timing controller 220 may transmit the generated data signal and source driving control signal to the source driver 320, and transmit the gate driving control signal to the gate driver 310.

Here, the timing controller 220 may transmit the driving control signal to the driver 300 using any one interface of RSDS, Mini-LVDS, PPDS, LVDS, Aipi, SVDL, and Vx1.

The driver 300 may drive the LCD panel 230 in accordance with the driving control signal. The driver 300 may include a source printed board assembly (PBA) board and a gate PBA board.

A source driver 320 may be arranged on the source PBA board. Further, a plurality of source drivers 320 may be arranged on the source PBA board.

The source driver 320 may convert a data signal received from the timing controller 220 into an analog signal, and output the analog signal to data lines. Further, the source driver 320 may include a plurality of source drive ICs.

The source driver 320 may convert the interface of the driving control signal that is output from the timing controller 220, and compensate for distortion of the driving control signal. On the other hand, in this embodiment, it is described that the source driver performs interface conversion of the driving control signal and distortion compensation. However, a separate IC may perform such interface conversion and distortion compensation.

The gate PBA board includes the gate driver 310, and the gate driver includes a plurality of gate drive ICs. The gate driver 310 may receive the gate driving control signal and drive gate lines according to the gate driving control signals.

The LCD panel 230 may be driven by the driver 300 and display a screen corresponding to the input video signal. Specifically, the LCD panel 230 includes an array substrate on which a plurality of unit pixels that are defined by the gate lines and the data lines crossing each other are formed, and an opposite substrate coupled to the array substrate to accommodate a liquid crystal layer. The detailed configuration of the unit pixel will be described layer with reference to FIG. 5.

The power supply 240 generates and provides a common voltage that is used in the display panel 230. Here, the common voltage is a voltage that is applied to the common electrode of the display panel 230, and typically has a voltage level that is ½ of a gamma voltage is applied.

Further, the power supply 240 generates and provides a gamma voltage that is used in the driver 300. Here, the gamma voltage is a voltage that is used by the driver 300 to generate an applied voltage, and the gamma voltage has a voltage level that is equal to or higher than the maximum level of the applied voltage.

Figure 5:
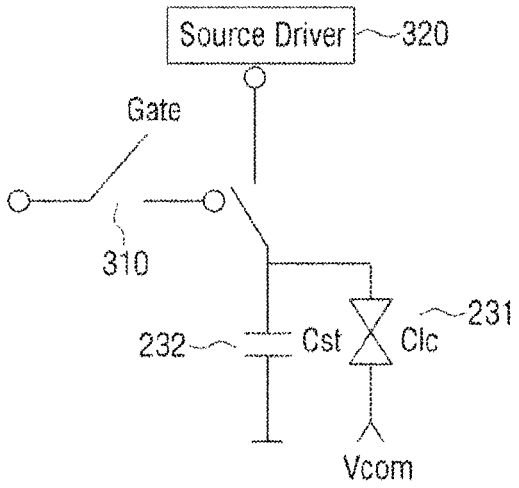
FIG. 5 is an equivalent circuit diagram of a liquid crystal cell of FIG. 4.

FIG. 5 is an equivalent circuit diagram of a liquid crystal cell of FIG. 4.

Referring to FIG. 5, a pixel unit includes a thin film transistor (TFT) that is a switching device connected to a gate line and a data line, a liquid crystal capacitor (CLC) 231 and a storage capacitor (CST) 232 connected to the thin film transistor.

The TFT is turned on by a gate voltage that is applied through the gate line, and a data voltage that is applied through the data line is applied to the liquid crystal capacitor (CLC). Through this, the liquid crystal capacitor (CLC) adjusts the light transmittance, and thus the LCD panel 230 displays an image.

Figure 6:
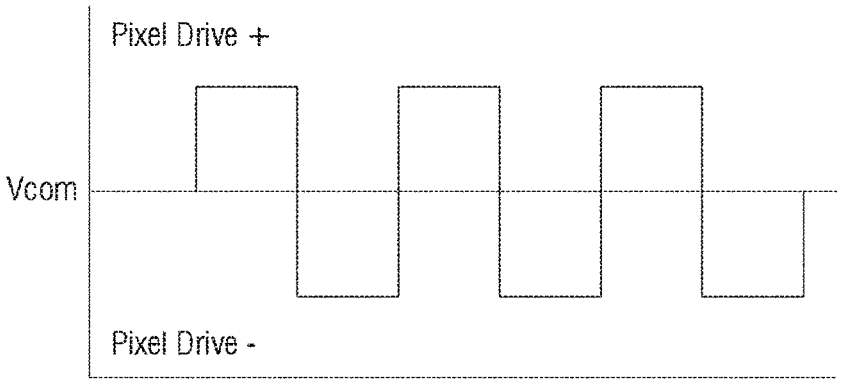
FIG. 6 is a waveform diagram illustrating an output example of a driver.

Recently, for the lifespan and reliability of liquid crystals, as illustrated in FIG. 6, (+) and (−) data voltages are alternately applied to the data line on the basis of the common voltage. That is, if the data voltage (applied voltage) is higher than the common voltage, the data voltage is regarded as positive. In addition, if the data voltage is lower than the common voltage, the data voltage is regarded as negative. Here, the common voltage may have an intermediate voltage level in a change range of the applied voltage that is applied to the LCD panel. For example, the common voltage may have a voltage level that is ½ of the gamma voltage level.

On the other hand, in the case where the LCD panel 230 is a normally black panel, in order to control the corresponding pixel to transmit no light, the applied voltage should have the same voltage level as the common voltage level. However, in the case where the common voltage has a constant level that is equal to ½ of the gamma voltage level, it is required to supply a voltage to the buffer in the source driver 320.

However, the buffer 323 is a constituent element that consumes largest power in the source driver 320, and thus even in a state where an image is not displayed on the screen, the power consumption of the whole system is not greatly reduced due to the power consumption of the buffer.

On the other hand, in order to solve the above-described problem, power supply to the backlight and the buffer may be blocked, and in this case, the backlight may not emit light. However, this method is not applicable in the case where it is required to keep a black screen except for a partial region of the screen.

Figure 7:
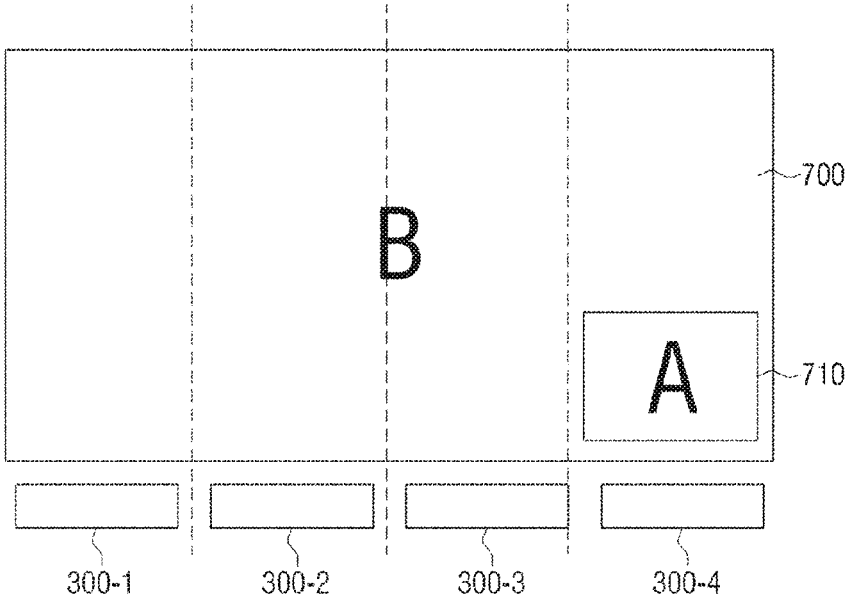
FIG. 7 is a diagram explaining an operation example of a driver.

That is, as shown in FIG. 7, in the case where it is required to display an image only on a partial region 710 of the screen while the remaining region of the screen is kept black, the power supplied to the backlight should not be blocked, and thus it becomes difficult to block the power supplied to the buffer.

In order to address this problem, in this embodiment, a switcher is provided to directly provide an intermediate voltage of a predetermined level, which makes the LCD panel transmit no light, to the LCD panel in the case where the power supplied to the buffer is blocked. The detailed configuration of the source driver for such an operation will be described with reference to FIG. 8.

Figure 8:
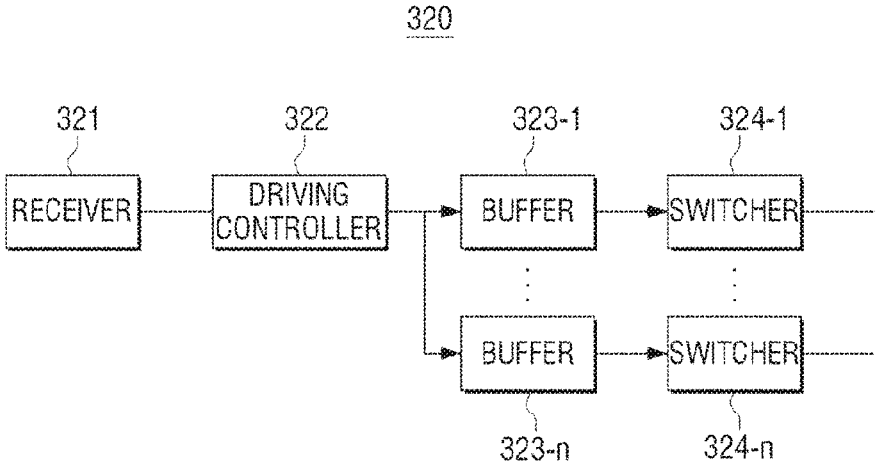
FIG. 8 is a block diagram illustrating the detailed configuration of a source driver of FIG. 4.

FIG. 8 is a block diagram illustrating the detailed configuration of a source driver of FIG. 4.

Referring to FIG. 8, the source driver 320 includes a receiver 321, a driving controller 322, a plurality of buffers 323, and a plurality of switchers 324. The source driver 320 may be arranged on a source PBA board.

The receiver 321 may receive the driving control signal from the timing controller 220. The driving control signal is a digital signal.

The driving controller 322 may control the buffers 323 to generate an applied voltage corresponding to the driving control signal that is transferred through the receiver 321. In this case, the driving controller 322 can simultaneously control the plurality of buffers 323.

Further, the driving controller 322 may sense whether a predetermined event has occurred. Specifically, if a column in which all rows output black images is sensed, the driving controller 322 may sense that the corresponding column is in an event situation in which a power saving mode is required. Further, if information for notifying of a power saving mode is received from the controller 190 or the timing controller 220, the driving controller 322 may determine the event situation in which the power saving mode is required.

Further, if a predetermined event has occurred, the driving controller 322 may control the switchers to block the power supplied to the buffers 323 and to directly provide the intermediate voltage to the LCD panel.

The buffers 323 may generate an applied voltage that corresponds to the driving control signal. In this case, the buffers 323 may alternately generate the applied voltage that is higher or lower than the common voltage to the extent of an electric potential difference corresponding to the driving control signal on the basis of the common voltage.

The switcher 324 may selectively provide the intermediate voltage to the LCD panel. Specifically, under the control of the driving controller, the switcher 324 may provide the intermediate voltage to pixels to which a power saving mode is applied during the power saving mode. On the other hand, the intermediate voltage may have a predetermined voltage level which makes the LCD panel to transmit no light. The intermediate voltage may have the same voltage level as the common voltage level. Further, the intermediate voltage may have an intermediate voltage level in a change range of the applied voltage that is applied to the LCD panel. On the other hand, the intermediate voltage may be provided from an external power supply outside of the driver 300, or may be provided by the switcher 324 using the gamma voltage.

Further, the switcher 324 may selectively provide the gamma voltage to the buffer 323. Specifically, the switcher 324 may selectively block the gamma voltage supplied to the buffer 323 in the power saving mode under the control of the driving controller 322.

Hereinafter, the operation states of the switcher and the buffer according to the operation mode will be described with reference to FIGS. 9 to 11. Hereinafter, for simplicity, explanation will be made on the basis of one pixel unit. However, it will be apparent that a plurality of buffers and a plurality of switchers may be provided in the source driver.

Figure 9:
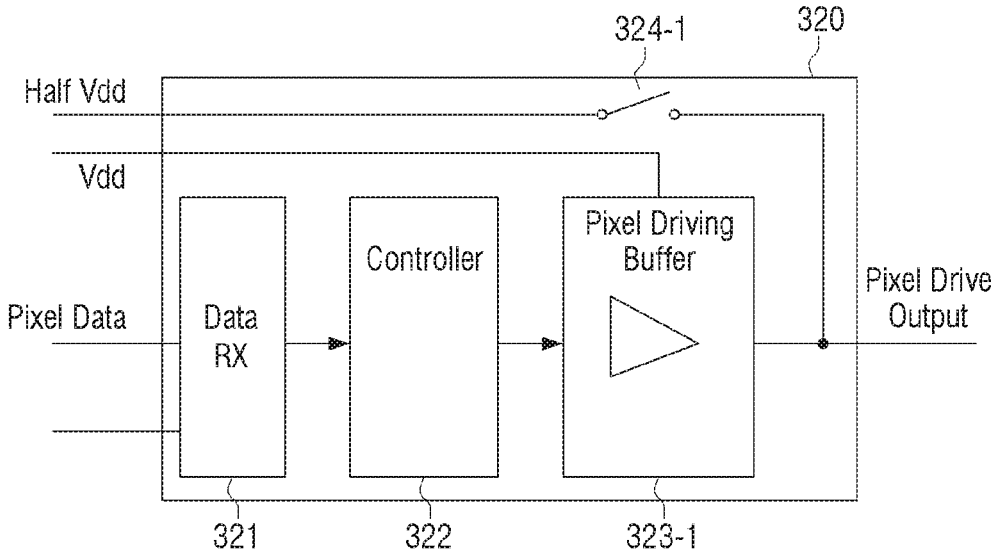
FIG. 9 is a diagram explaining an operation state of a source driver in a normal mode.

FIG. 9 is a diagram explaining an operation state of a source driver in a normal mode. Specifically, if information notifying that the present operating mode is not a power saving mode is input as shown in the first half of the waveform diagram of FIG. 11, a switch that provides the intermediate voltage to the LCD panel is deactivated.

The driving controller 322 may control the buffer 323-1 to generate the applied voltage that corresponds to the driving control signal using the provided gamma voltage. Accordingly, the applied voltage that is supplied to the LCD panel may be the voltage that is generated by the buffer 323-1.

Figure 10:
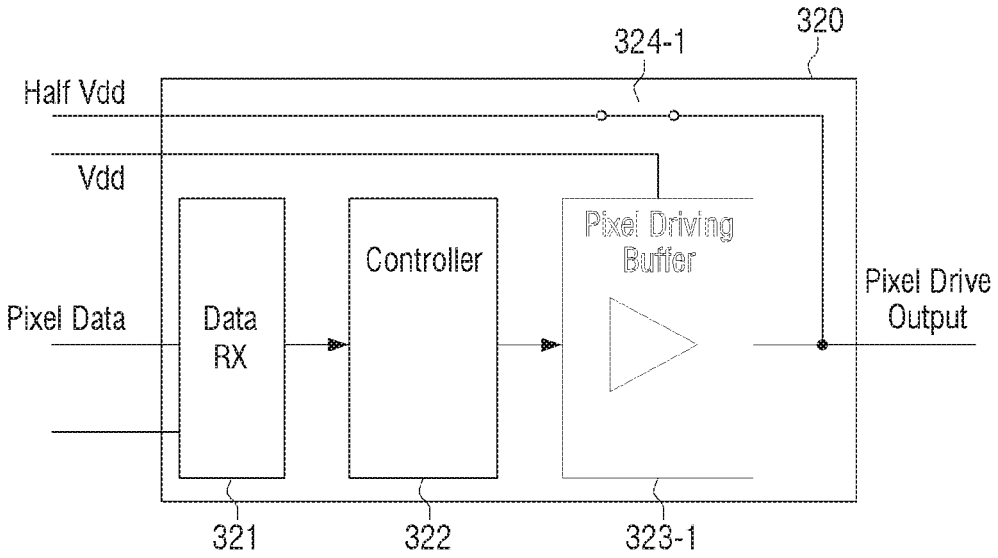
FIG. 10 is a diagram explaining an operation state of a source driver in a power saving mode.

FIG. 10 is a diagram explaining an operation state of a source driver in a power saving mode.

Figure 11:
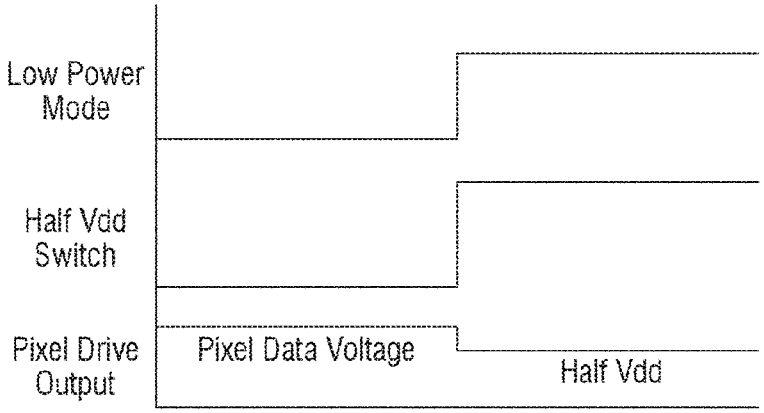
FIG. 11 is a waveform diagram illustrating signals applied to a source driver and an output voltage thereof.

Referring to FIG. 10, if information notifying that the present operating mode is a power saving mode is input as shown in the second half of the waveform diagram of FIG. 11, a switch that provides the intermediate voltage to the LCD panel is activated, and the driving controller 322 may control the buffer 323-1 to turn off the power.

On the other hand, a diode is arranged at an output terminal of the buffer 323-1, and the intermediate voltage that is provided to the LCD panel is not applied toward the buffer 323-1. On the other hand, for safety reasons, a second switch that operates oppositely to the switcher that provides the intermediate voltage to the LCD panel may be arranged on the side of the output terminal of the buffer.

Figure 12:
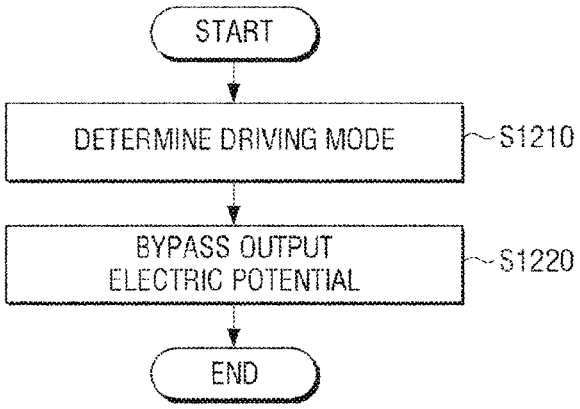
FIG. 12 is a flowchart explaining a method for controlling a display device according to an exemplary embodiment.

FIG. 12 is a flowchart explaining a method for controlling a display device according to an exemplary embodiment.

Referring to FIG. 12, it is sensed whether a predetermined event has occurred (S1210). Specifically, it may be determined according to whether the display device 100 does not output an image or displays an image only on a partial region of the screen while displaying no image on the remaining region of the screen. In the latter case, a column in which all rows output black images is sensed, and it is determined that the corresponding column should be operated in a power saving mode.

If a predetermined event has occurred, a bypass is performed so that an intermediate voltage of a predetermined level is provided to an LCD panel instead of an applied voltage (S1220). Specifically, gamma voltage supplied to a buffer is blocked (or the buffer is deactivated), and the switching state is varied to directly provide the intermediate voltage of the predetermined level to the LCD panel.

As described above, according to the method for controlling a display device according to this embodiment, even in the case where the pixel data is kept constant without any change or the pixels are turned off, the power supplied to the buffer can be blocked, and thus power consumption can be minimized. The method for controlling a display device as illustrated in FIG. 12 may be performed on the display device having the configuration as illustrated in FIG. 1, and may be executed even on a display device having another configuration.

Further, the method for controlling a display device according to the embodiments of the present disclosure may be implemented by a program that includes an executable algorithm that can be executed by a computer, and the above-described program may be stored in a non-transitory computer readable medium to be provided.

A non-transitory computer readable medium is not a medium that stores data for a short period, such as a register, a cache, or a memory, but means a medium which semi-permanently stores data and is readable by a device. Specifically, the above-described programs may be stored and provided in the non-transitory computer readable medium, such as, a CD, a DVD, a hard disc, a Blu-ray disc, a USB, a memory card, and a ROM.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A display device comprising:

a liquid crystal display (LCD) panel configured to change a liquid crystal transmittance in accordance with an applied voltage;

a buffer configured to generate the applied voltage corresponding to a driving control signal;

a first switcher configured to selectively provide an intermediate voltage of a predetermined level to the LCD panel, the intermediate voltage causing the LCD panel not to transmit light;

a second switcher configured to selectively provide a gamma voltage to the buffer;

a third switcher arranged on an output terminal of the buffer and configured to perform switching operations oppositely to the first switcher; and a driving controller configured to:

control the first switcher to turn off and control the second switcher to turn on the buffer, in response to receiving a first signal representing that the display device is in a first mode, and control the first switcher to turn on and control the second switcher to turn off the buffer, in response to receiving a second signal representing that the display device is in a second mode, wherein the driving controller transmits a signal for turning on the buffer to the buffer if the first switcher turns off, and wherein the driving controller transmits a signal for turning off the buffer to the buffer if the first switcher turns on.

2. The display device as claimed in claim 1, wherein the LCD panel is a normally black panel that blocks light when the applied voltage is equal to a common voltage.

3. The display device as claimed in claim 2, wherein the common voltage has an intermediate level in a change range of the applied voltage that is applied to the LCD panel.

4. The display device as claimed in claim 2, wherein the intermediate voltage has a voltage level that is equal to the common voltage.

5. The display device as claimed in claim 2, wherein the intermediate voltage has an intermediate level in a change range of the applied voltage that is applied to the LCD panel.

6. The display device as claimed in claim 2, wherein the buffer is configured to alternately generate the applied voltage that is higher or lower than the common voltage to an extent of an electric potential difference corresponding to the driving control signal based on the common voltage.

7. The display device as claimed in claim 1, wherein the buffer is configured to receive the gamma voltage to generate the applied voltage, and the first switcher is configured to generate the intermediate voltage by using the gamma voltage.

8. The display device as claimed in claim 1, further comprising a plurality of buffers including the buffer, and a plurality of switchers including the first switcher, wherein the driving controller is configured to control power supply states of the plurality of buffers, and control operations of the plurality of switchers corresponding to the respective buffers in accordance with the power supply states of the plurality of buffers.

9. The display device as claimed in claim 8, wherein at least one of the plurality of buffers is in a normal state, and remaining buffers of the plurality of buffers, other than the least one of the plurality of buffers, are in a power blocking state.

10. The display device as claimed in claim 8, wherein the driving controller is configured to sense a column in which all rows output black images, block power from being supplied to a buffer corresponding to the sensed column among the plurality of buffers and control a switcher corresponding to the buffer among the plurality of switchers to provide the intermediate voltage to the LCD panel.

11. The display device as claimed in claim 1, wherein the buffer, the first switcher, and the driving controller are arranged on a source printed board assembly.

12. The display device as claimed in claim 1, wherein the first mode is a normal mode and the second mode is a power saving mode.

13. A driving board for driving a liquid crystal display (LCD) panel, the driving board comprising:

a buffer configured to generate an applied voltage corresponding to a driving control signal, and to provide the generated applied voltage to the LCD panel;

a first switcher configured to selectively provide an intermediate voltage of a predetermined level to the LCD panel, the intermediate voltage causing the LCD panel not to transmit light;

a second switcher configured to selectively provide a gamma voltage to the buffer;

a third switcher arranged on an output terminal of the buffer and configured to perform switching operations oppositely to the first switcher; and a driving controller configured to:

control the first switcher to turn off and control the second switcher to turn on the buffer, in response to receiving a first signal representing that a display device including the LCD panel is in a first mode, and control the first switcher to turn on and control the second switcher to turn off the buffer, in response to receiving a second signal representing that the display device is in a second mode, wherein the driving controller transmits a signal for turning on the buffer to the buffer if the first switcher turns off, and wherein the driving controller controls a signal for turning off the buffer to the buffer if the first switcher turns on.

14. The driving board as claimed in claim 13, further comprising a plurality of buffers including the buffer, and a plurality of switchers including the first switcher, wherein the driving controller is configured to control power supply states of the plurality of buffers, and control operations of the plurality of switchers corresponding to the respective buffers in accordance with the power supply states of the plurality of buffers.

15. The driving board as claimed in claim 14, wherein at least one of the plurality of buffers is in a normal state, and remaining buffers of at least one of the plurality of buffers, other than the at least one of the plurality of buffers, are in a power blocking state.

16. The driving board as claimed in claim 14, wherein the driving controller is configured to sense a column in which all rows output black images, blocks power from being supplied to the buffer that corresponds to the sensed column, and controls the first switcher that corresponds to the buffer to provide the intermediate voltage to the LCD panel.

17. The driving board as claimed in claim 13, wherein the first mode is a normal mode and the second mode is a power saving mode.

* * * * *